US007726225B2

(12) United States Patent
Imamura et al.

(10) Patent No.: US 7,726,225 B2
(45) Date of Patent: Jun. 1, 2010

(54) MITER SAW HAVING HOLDER FIXING MECHANISM

(75) Inventors: Ryuichi Imamura, Hitachinaka (JP); Shigeharu Ushiwata, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 12/266,886

(22) Filed: Nov. 7, 2008

(65) Prior Publication Data

US 2009/0071308 A1 Mar. 19, 2009

Related U.S. Application Data

(63) Continuation of application No. 11/078,398, filed on Mar. 14, 2005.

(30) Foreign Application Priority Data

Mar. 26, 2004 (JP) ..... P2004-092738

(51) Int. Cl.
*B27B 5/20* (2006.01)

(52) U.S. Cl. ..... 83/471.3; 83/473; 83/490; 83/581; 83/486.1; 83/477.1

(58) Field of Classification Search ..... 83/471.2, 83/471.3, 490, 581, 473, 478, 397, 485, 486.1, 83/487, 488, 477.1; 30/376; 144/216, 217
See application file for complete search history.

(56) References Cited

U.S. PATENT DOCUMENTS 4,152,961 A 5/1979 Batson
4,537,105 A 8/1985 Bergler
4,869,142 A * 9/1989 Sato et al. ..... 83/467.1
5,054,352 A 10/1991 Fushiya
5,060,548 A 10/1991 Sato
5,216,964 A * 6/1993 Sato et al. ..... 83/471.3
5,421,228 A * 6/1995 Fukinuki ..... 83/471.3
5,582,089 A 12/1996 Sasaki
D388,443 S * 12/1997 Kondo ..... D15/133

(Continued)

FOREIGN PATENT DOCUMENTS

CA 2 372 451 8/2003

(Continued)

*Primary Examiner*—Boyer D. Ashley
*Assistant Examiner*—Laura M. Lee
(74) *Attorney, Agent, or Firm*—Antonelli, Terry, Stout & Kraus, LLP.

(57) ABSTRACT

A miter saw includes a base section on which a workpiece is mounted, a saw blade section supporting a circular saw blade having a rotation axis extending in a lateral direction, a holder shaft extending in a direction perpendicular to the rotation axis, a holder tiltable about the holder shaft, two parallel guide bars disposed slidable with respect to the holder and extending toward the rotation axis, a support segment fixed to the guide bars and supporting the saw blade section, a pivot shaft disposed between the saw blade section and the support segment and extending in parallel with the rotation axis so that the saw blade section is pivotable about the pivot shaft, and a holder fixing mechanism that fixes a tilting posture of the holder and includes an operation member supported to the holder and having a rotatable shaft passing through a space between the two guide bars.

13 Claims, 9 Drawing Sheets

U.S. PATENT DOCUMENTS

| | | | | |
|---|---|---|---|---|
| D389,494 | S * | 1/1998 | Chen | D15/133 |
| 5,862,732 | A | 1/1999 | Itzov | |
| 5,862,734 | A | 1/1999 | Brunson | |
| 6,016,732 | A | 1/2000 | Brault | |
| 6,561,068 | B2 * | 5/2003 | Meredith et al. | 83/471.3 |
| 6,758,123 | B2 * | 7/2004 | Svetlik et al. | 83/471.3 |
| 7,021,186 | B2 | 4/2006 | Brazell | |
| 2001/0049988 | A1 | 12/2001 | Ushiwata | |
| 2003/0070521 | A1 | 4/2003 | Stumpf | |
| 2003/0088986 | A1 * | 5/2003 | Ushiwata et al. | 30/376 |
| 2003/0226436 | A1 | 12/2003 | Higuchi | |
| 2004/0112190 | A1 * | 6/2004 | Hollis et al. | 83/13 |
| 2005/0098010 | A1 | 5/2005 | Hu | |
| 2005/0098011 | A1 | 5/2005 | Kao | |
| 2006/0060048 | A1 * | 3/2006 | Stumpf et al. | 83/471.3 |

FOREIGN PATENT DOCUMENTS

| | | |
|---|---|---|
| CN | 1165063 | 11/1997 |
| JP | 9-164504 | 6/1997 |
| JP | 11-048029 | 2/1999 |
| JP | 11-254401 | 9/1999 |

* cited by examiner

MITER SAW HAVING HOLDER FIXING MECHANISM

CROSS REFERENCE TO RELATED APPLICATION

This application is a continuation of U.S. application Ser. No. 11/078,398, filed Mar. 14, 2005, the contents of which are incorporated herein by reference.

BACKGROUND OF THE INVENTION

The present invention relates to a miter saw having a circular saw blade section pivotable about a first axis extending in a direction parallel with a rotation axis of the circular saw blade, and pivotally movable about a second axis extending horizontally and in a direction perpendicular to the rotation axis.

Japanese Patent Application Publication No. H11-254401 discloses a miter saw including a holder supporting a saw blade section having a circular saw blade. The saw blade section is pivotally movable toward and away from a base section about a first axis extending in a direction parallel with a rotation axis of the circular saw blade. The holder is pivotally movable about a holder shaft having a second axis extending horizontally along an upper surface of the base section and in a direction perpendicular to the rotation axis. Thus, the saw blade section is tiltable leftward and rightward about the holder shaft.

A clamp lever also extends in parallel with the holder shaft and protrudes rearward from the holder. By the rotation of the clamp lever about its axis, a pivot posture of the holder relative to the base section is clamped or released.

With this structure, a user's hand must sneak around to the rear side of the holder in order to manipulate the clamp lever. If a wall or an object exists nearby the rear side of the holder, access to the clamp lever becomes impossible, thereby disabling the change in pivot posture of the holder. In other words, a space is required at a position behind the clamp lever when installing the miter saw for facilitating the access to the clamp lever.

Further, normally, the user is positioned in front of the base section during cutting operation. However, when changing the pivot posture of the holder, the user must hold the saw blade section. Therefore, the user must move to a position beside the miter saw so as to access to the clamp lever and to the saw blade section. This movement may lower the workability.

This drawback becomes apparent in case of a miter saw having a slide mechanism. That is, the holder support a bar extending in the second direction, and the saw blade section is pivotally movably supported on a support section disposed on the bar. In the latter case, if the saw blade section is at the frontmost position in the second direction, a distance between the front side of the saw blade section and the holder becomes increased. Therefore, the user must move to the lateral side of the miter saw from the front side by the increased distance. This degrades the workability.

Japanese Patent Application Publication No. H11-48029 discloses a miter saw in which an operation member for clamping and unclamping the pivot posture of the holder extends in parallel with the holder shaft and protrudes from the front side of the base section.

With this structure, pivot posture can be clamped or unclamped by the operation of the operation member at the front side of the base section. However, the operation member must span between the holder and the front side of the base section, thereby increasing a length of the operation member. This leads to an increase in weight and production cost. Due to the elongated length of the operation member, excessive rotation force must be imparted on the operation member for clamping the pivot posture. Accordingly, deformation may occur in the operation member. In order to avoid this problem, a diameter of the operation member must be increased, which in turn leads to increase in weight and production cost. Further, since the operation member spans over a wide range, a degree of design freedom must be limited in designing the miter saw.

In a miter saw where the base section includes a base and a turntable rotatably supported on the base through a rotation shaft, and the above-described slide mechanism is provided, the holder is pivotally movably supported to the turntable. In this case, mechanical interference between the elongated operation member and the rotation shaft of the turntable must be avoided. To this effect, a lateral width of the front side of the turntable must be increased to increase a total weight of the miter saw.

SUMMARY OF THE INVENTION

It is an object of the present invention to overcome the above-described problem and to provide a miter saw with a laterally tiltable circular saw blade capable of enhancing operability in a reducing a working space for changing pivot posture of the holder.

This and other objects of the present invention will be attained by a miter saw including a base section, a saw blade section, a support section, a holder shaft, a holder, and a holder fixing mechanism. The section has an upper surface on which a workpiece is mounted. The base section defines a frontward/rearward direction and a lateral direction perpendicular to the frontward/rearward direction. The saw blade section rotatably supports a circular saw blade. The circular saw blade has a rotation axis extending in the lateral direction and has a pair of opposite side surfaces. The support section has a pivot shaft extending in parallel with the rotation axis. The saw blade section is pivotable about the pivot shaft and is movably supported to the support section toward and away from the upper surface. The holder shaft extends in a direction perpendicular to the rotation axis and in the frontward/rearward direction. The holder shaft has a holder shaft axis in flush with the upper surface. The holder is tiltable about the holder shaft in the lateral direction relative to the base section. The holder supports the support section. The holder fixing mechanism fixes a tilting posture of the holder relative to the base section. The holder fixing mechanism includes an operation member extending in a direction perpendicular to the holder shaft and substantially parallel with the opposite side surfaces of the circular saw blade. The operation member selectively provides a fixed association between the base section and the holder.

DETAILED DESCRIPTION OF THE PREFERRED EMBODIMENTS

Figure 1:
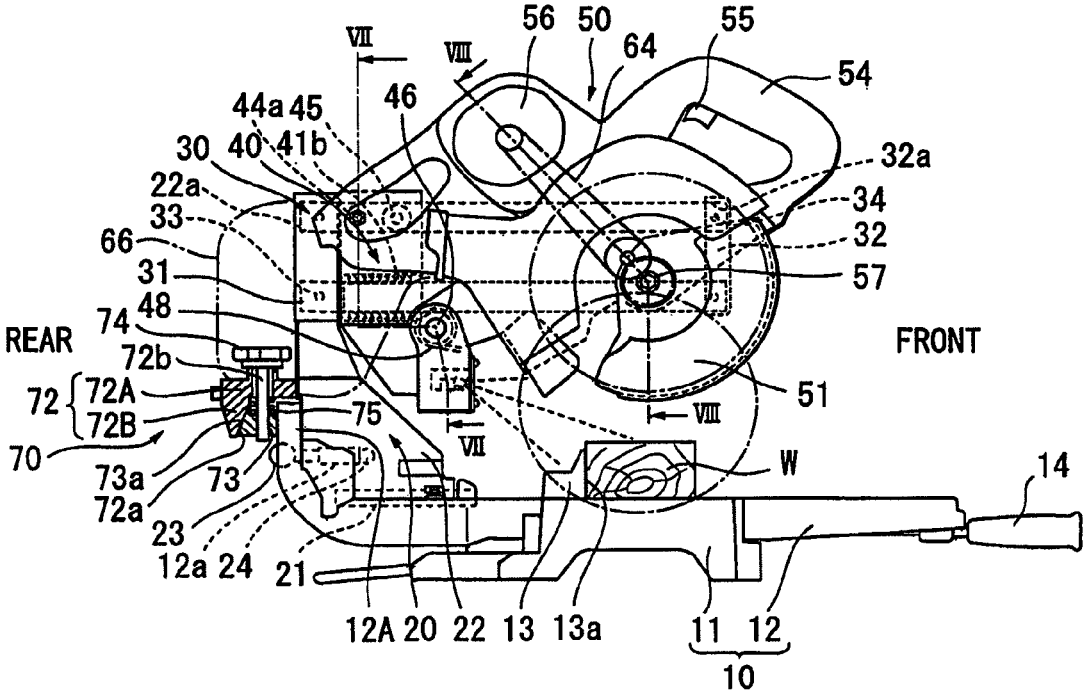
FIG. 1 is a side view of a miter saw with a laterally tiltable saw blade section according to a first embodiment of the present invention, and showing a state where the circular saw blade section is positioned at its rearmost and its uppermost position.
Figure 2:
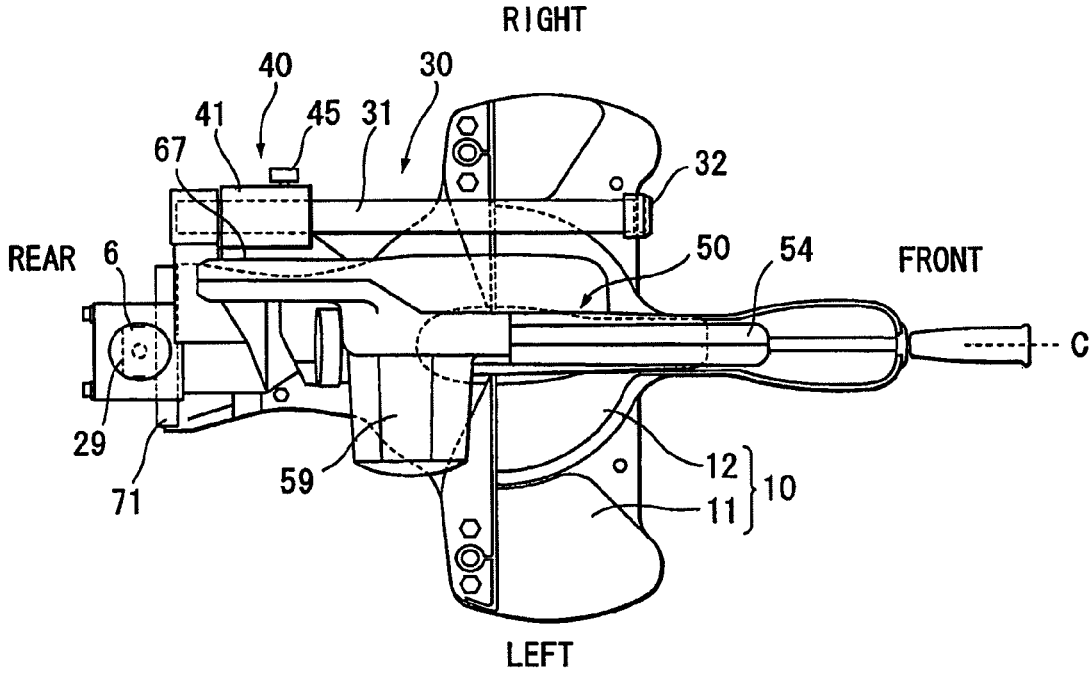
FIG. 2 is a plan view of the miter saw of FIG. 1.
Figure 3:
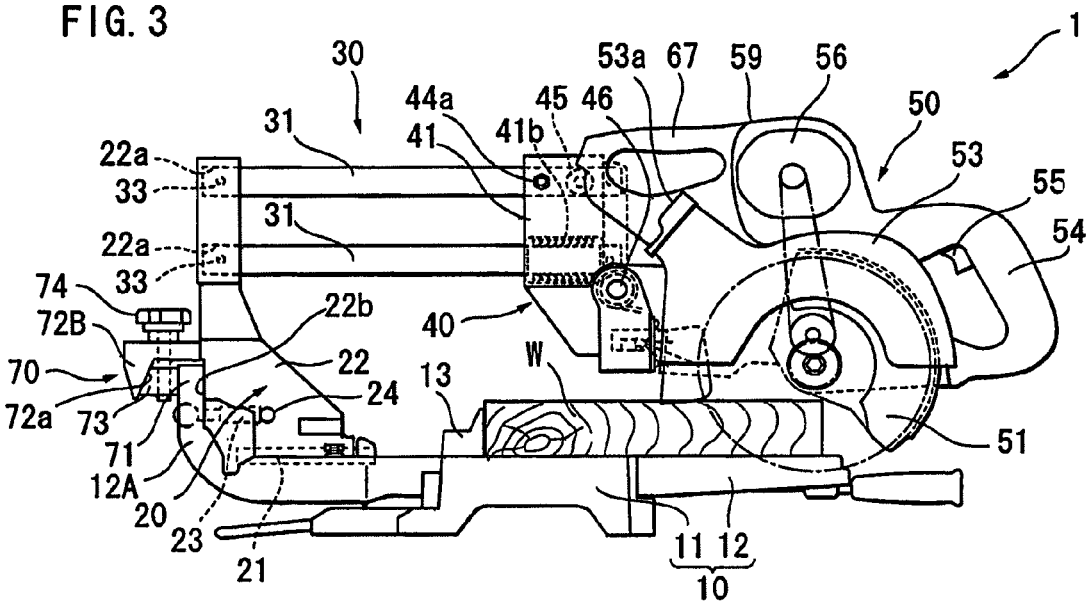
FIG. 3 is a side view of the miter saw according to the first embodiment, and showing a state where the saw blade section is positioned at its frontmost and its lowermost position.

A miter saw having a mechanism for laterally tilting a circular saw blade according to a first embodiment of the present invention will be described with reference to FIGS. 1 through 9. Unless otherwise noted, orientation terms, such as left, right, front, rear, up, and down, are used with respect to the normal orientation of the device for normal use. As shown in FIGS. 1 through 3, a miter saw 1 generally includes a base section 10, a guide bar support section 20, a guide bar section 30, a saw blade support section 40, and a saw blade section 50.

Figure 4:
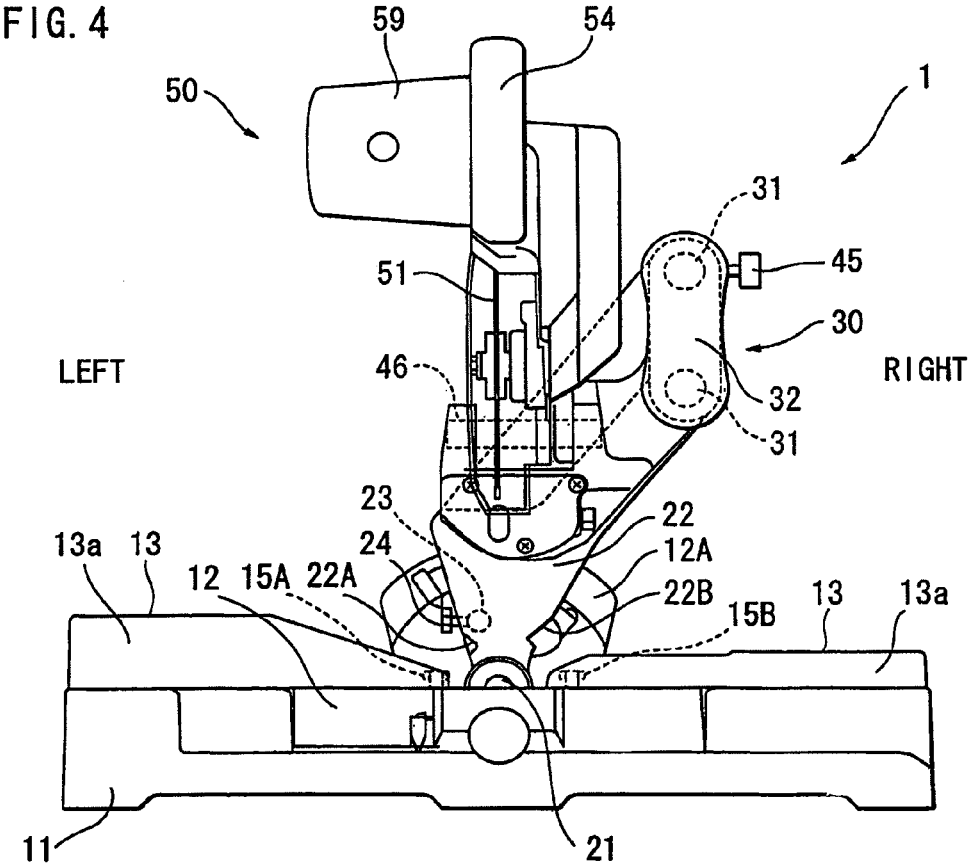
FIG. 4 is a front view of the miter saw and particularly showing a vertical orientation of a guide bar support section and the saw blade section.
Figure 5:
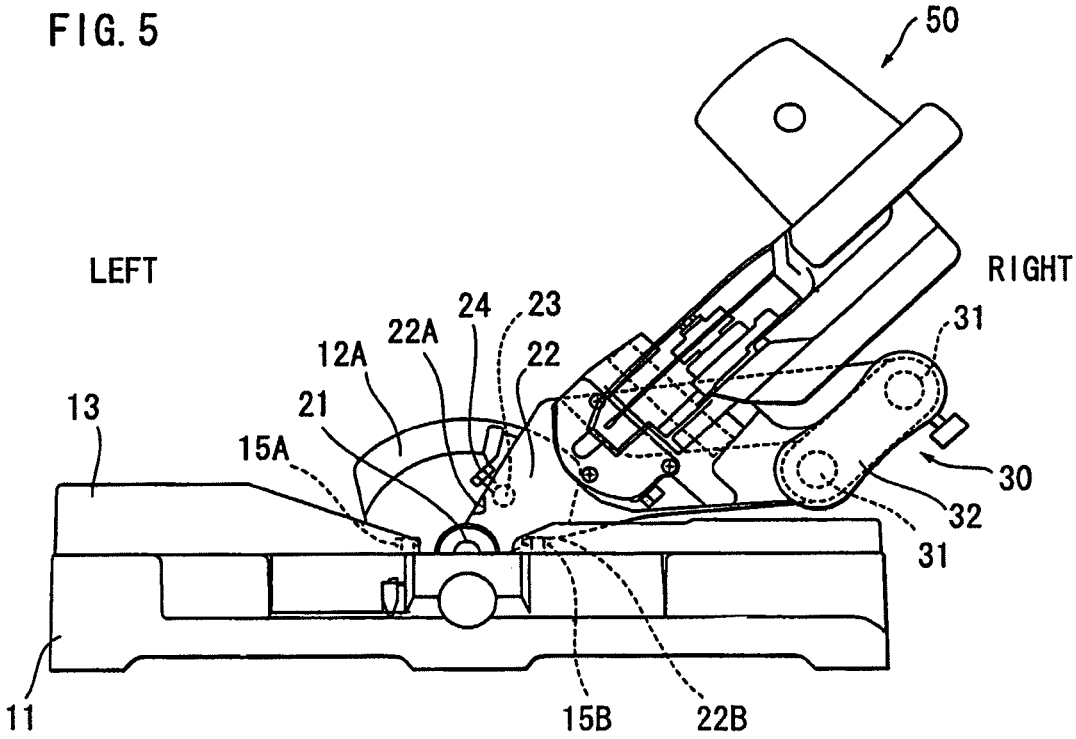
FIG. 5 is a front view of the miter saw and particularly showing a rightward tilting state of the guide bar support section and the saw blade section.
Figure 6:
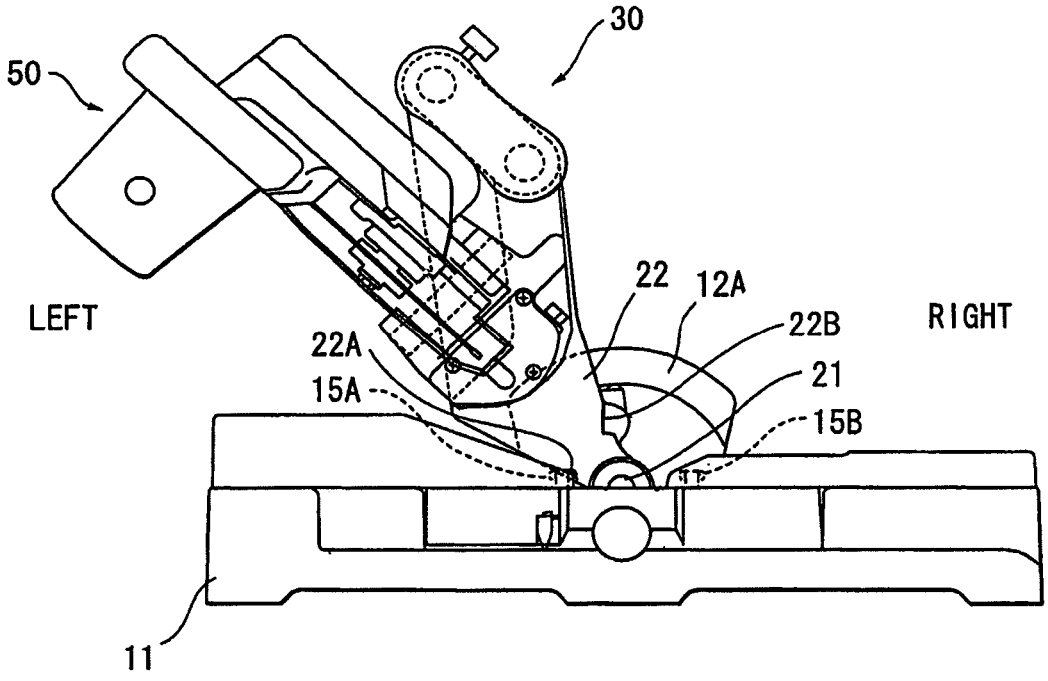
FIG. 6 is a front view of the miter saw and particularly showing a leftward tilting state of the guide bar support section and the saw blade section.

The base section 10 is adapted for mounting thereon a workpiece W to be cut. The guide bar support section 20 extends upwardly from the base section 10 and is pivotally supported to the base section 10 and tiltable laterally as shown in FIGS. 4 through 6. The guide bar section 30 is fixed to the guide bar support section 20 and extends in a horizontal and frontward/rearward direction. The saw blade support section 40 is supported on the guide bar support section 20 and movable between its rearmost position shown in FIG. 1 and a frontmost position shown in FIG. 3. The saw blade section 50 is pivotally supported to the saw blade support section 40 and movable between its uppermost pivot position shown in FIG. 1 and its lowermost pivot position shown in FIG. 3.

1. Base Section 10

The base section 10 includes a base 11 to be mounted on a floor or a table, and a turntable 12 rotatable on the base 11 in a horizontal plane. An upper surface of the turntable 12 is flush with an upper surface of the base 11. The workpiece W such as a wood is mounted on the base 11 and the turntable 12. A pair of fences 13 extends in line in a lateral direction (rightward/leftward direction) and protrude from the upper surface of the base 11 for positioning the workpiece W by abutting a vertical surface of the workpiece W with vertical abutment surfaces 13*a* of the fences 13. A blade entry plate formed with a groove (not shown) is fixed to a center portion of the upper surface of the turntable 12. The blade entry plate is adapted for preventing a cut surface of the workpiece W from being nappy or fluffy by permitting a lowermost blade tip of a circular saw blade 51 (described later) to be entered into the groove when the lowermost blade tip is positioned lower than the upper surface of the turntable. The turntable 12 has a rearmost upstanding portion 12A. A knob 14 is disposed at the front side of the turntable 12 for angularly rotating the turntable 12 about its axis and for fixing the angular rotational position of the turntable 12 relative to the base 11. At a rear portion of the turntable 12 and near the rearmost upstanding portion 12A, a through-hole 12*a* extending in frontward/rearward direction is formed.

2. Guide Bar Support Section 20

The guide bar support section 20 is pivotally movably supported to a rear end portion of the turntable 12. Therefore, by the rotation of the turntable 12 relative to the base 11, positions of the guide bar support section 20, the guide bar section 30, the saw blade support section 40 and the saw blade section 50 relative to the fences 13 is changed. Thus, an angle between the abutment surface 13*a* and a circular side surface of the circular saw blade 51 is changed. Accordingly, the workpiece W can be cut at a desired angle relative to the frontward/rearward direction (angled cutting).

The guide bar support section 20 generally includes a holder shaft 21, a holder 22, and a holder fixing mechanism 70 described later. The holder shaft 21 extends in the frontward/rearward direction at a rear side of the turntable 12. The holder shaft 21 has an axis positioned substantially coincident with the upper surface of the turntable 12. The holder 22 has a lower end portion pivotally movably supported on the holder shaft 21. Therefore, the holder 22 is laterally movable with respect to the turntable 12 about the holder shaft 21. The holder 22 has an upper portion to which the guide bar section 30 is fixed.

As shown in FIGS. 4 through 6, stop portions 22A and 22B are formed at lateral end faces of the holder 22 for regulating a laterally tilting angle of the holder 22. Further, stop bolts 15A, 15B vertically extend from the upper rear surface of the turntable 12 at position on a locus of the stop portions 22A, 22B. The stop bolts 15A, 15B are threaded into the turntable 12. If the holder 22 is tilted in the lateral direction, the stop portion 22A or 22B is brought into abutment with the head of the stop bolt 15A or 15B, whereupon the tilting angle of the holder 22 can be set. Ordinarily, the stop bolts 15A, 15B are provided to laterally tilt the holder 22 at an angle of 45 degrees upon abutment with the stop portion 15A, 15B.

A pin 23 extends through the through-hole 12*a* of the turntable 12 and is movable between frontmost and rearmost positions for regulating the vertical orientation of the holder 22. A stop bolt 24 horizontally extends through the holder 22. A tip end of the stop bolt 24 is positioned abuttable on an outer peripheral surface of the pin 23 when the pin 23 is positioned at its frontmost position and when the holder 22 is at its vertical position. The tip end of the stop bolt 24 is positioned offset from the outer peripheral surface of the pin 23 when the pin 23 is displaced to its rearmost position. The holder fixing mechanism 70 is adapted for fixing a laterally tilting angle of the holder 22. Details of the holder fixing mechanism 70 will be described later. Upon fixing the pivot angle of the holder 22, the tilting angle of the circular saw blade 51 is fixed, thereby performing slant cutting.

3. Guide Bar Section 30

As shown in FIGS. 2 through 4, the upper end portion of the holder 22 is positioned laterally displaced from the lateral center C of the base section 10, and is formed with a pair of bores 22*a*, 22*a* extending in parallel with the side surface of the circular saw blade 51 as shown in FIG. 2 and in parallel with the upper surface of the base 11 as shown in FIG. 3. When the holder 22 is at its vertical posture shown in FIG. 4, the pair of bores 22*a*, 22*a* are arrayed in a vertical plane as shown in FIG. 4.

The guide bar section 30 generally includes a pair of guide bars 31,31 and an front end cap 32. The guide bars 31 have lengths equal to each other and shorter than a longitudinal length of the turntable 12 (the longitudinal length extends in the frontward/rearward direction). The guide bars 31 have tubular shape and have circular cross-section whose outer diameter is substantially equal to an inner diameters of the pair of bores 22*a*, 22*a*. The guide bars 31 provide sufficient rigidity.

Each rear end of each guide bar 31 is inserted into each bore 22*a*. In order to avoid accidental release of the guide bars 31 from the bores 22*a* or to avoid accidental rotation of the guide bars 31 about their axes within the bores 22*a*, a pair of female threads in communication with the respective bores 22*a* are formed in the holder 22 in a radial direction of the guide bar 31, and fixing bolts 33 are threadingly engaged with the corresponding female threads, so that tip ends of the fixing bolts 33 can press against the outer peripheral surfaces of the guide bars 31. Thus, the guide bars 31 extend in parallel with the side surface of the circular saw blade 51 as shown in FIG. 2 and in parallel with the upper surface of the base 11 as shown in FIG. 4. When the holder 22 is at its vertical posture shown in FIG. 4, the guide bars 31 are arrayed in a vertical plane as shown in FIG. 4. Alternatively, the outer diameter of the guide bars 31 is slightly greater than the inner diameters of the pair of bores 22*a*, 22*a*. In the latter case, the guide bars 31 are force-fitted with the bores 22*a*, and the fixing bolts 33 can be dispensed with.

Each front end of the guide bar 31 is fixed to the front end cap 32. To this effect, the front end cap 32 is formed with a pair of bores 32*a*, 32*a* extending in parallel with each other and having inner diameter substantially equal to the outer diameter of the guide bar 31. Further, a pair of female threads in communication with the respective bores 32*a* are formed in a radial direction of the guide bar 31, and fixing bolts 34 are threadingly engaged with the corresponding female threads, so that tip ends of the fixing bolts 34 can press against the outer peripheral surfaces of the front end portion of the guide bars 31. Thus, rotation of the guide bars 31 relative to the front end cap 32 is prevented, and the front end cap 32 is fixedly secured to each front end of the guide bar 31. Thus rear ends and front ends of the guide bars 31 are fixed to the holder 22, and the front end cap 23, respectively.

4. Saw Blade Support Section 40

The saw blade support section 40 is adapted to pivotally movably support the saw blade section 50, and is movable relative to the guide bars 31 between a rearmost position defined by the holder 22 and a frontmost position defined by the front end cap 32. Further, the saw blade support section 40 can be fixed to the guide bars 31.

Figure 7:
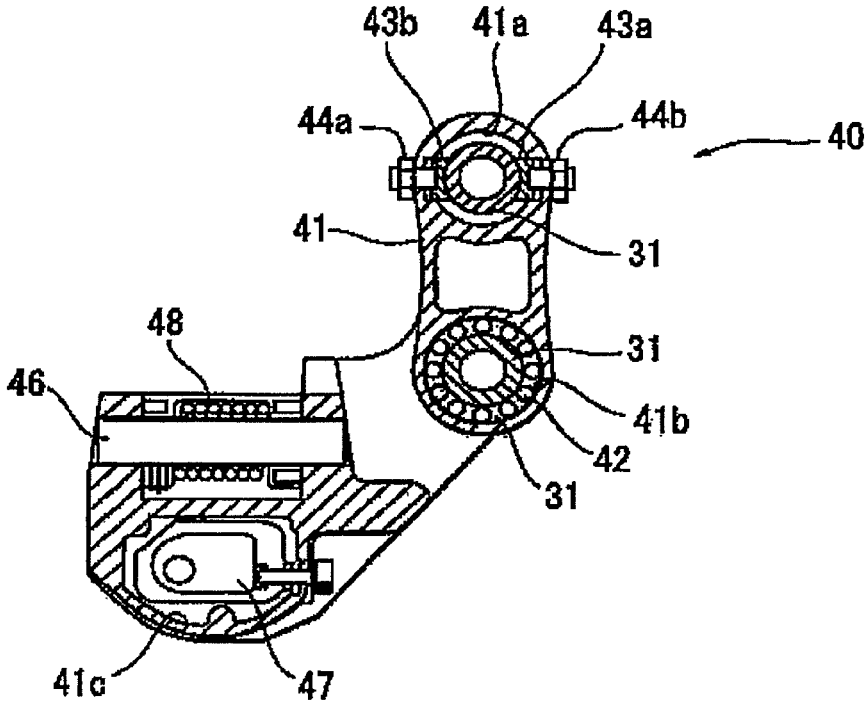
FIG. 7 is a cross-sectional view taken along the line VII-VII in FIG. 1 for particularly showing a saw blade support section.

The saw blade support section 40 includes a support segment 41 slidably movable between the holder 22 and the front end cap 32. The saw blade section 50 is movably supported on the support segment 41. More specifically, as shown in FIG. 7, the support segment 41 is formed with an upper bore 41*a* and a lower bore 41*b* through which the upper guide bar 31 and the lower guide bar 31 extend, respectively. The upper bore 41*a* is substantially concentric with the upper guide bar 31 and has an inner diameter greater than the outer diameter of the upper guide bar 31. The lower bore 41*b* is substantially concentric with the lower guide bar 31 and has an inner diameter greater than the outer diameter of the lower guide bar 31.

As shown in FIG. 7, a ball bearing 42 is disposed in the lower bore 41*b*. The ball bearing 42 has an inner diameter approximately equal to the outer diameter of the lower guide bar 31, and has an outer peripheral surface in sliding contact with the lower bore 41*b*. The lower bore 41*b* has an axial length approximately equal to an axial length of the ball bearing 42. This axial length is the minimum length for maintaining sufficient sliding performance of the support segment 41 relative to the guide bars 31.

Two sliding segments 43*a*, 43*b* are disposed in the upper bore 41*a* and in sliding contact with the outer peripheral surface of the upper guide bar 31. Bolts 44*a*, 44*b* extend in radial direction of the upper guide bar 31 and are threadingly engaged with the support segment 41. The bolts 44*a*, 44*b* have inner ends supporting the sliding segments 42*a*, 43*b*. Thus, the sliding segments 43*a*, 43*b* are movable in the radial direction of the upper guide bar 31 by the axial movement of the bolts 44*a*, 44*b* caused by the threading engagement. A knob 45 is threadingly engaged with the support segment 41 and is engagable with the upper guide bar 31. By fastening the knob 45, the movement of the support segment 41 relative to the upper guide bar 31 can be stopped.

In FIG. 7, by controlling the axial positions of the bolts 44*a* and 44*b* caused by the threading advancement or retraction thereof, the positions of the two sliding segments 43*a*, 43*b* can be changed. Thus, relative position between the support segment 41 and the upper guide bar 31 can be changed. That is, a minute pivotal movement of the support segment 41 about an axis of the lower guide bar 31 can be performed. To be more specific, in FIG. 7, by moving the two sliding segments 43*a*, 43*b* leftward, the left end of the upper guide bore 31 is moved toward the upper bore 41*a*, i.e., the support segment 41 is pivotally and finely moved in a clockwise direction in FIG. 7 about the axis of the lower guide bar 31. Consequently, the saw blade section 50 and its circular saw blade 51 are also pivotally moved about the axis of the lower guide bar 31. Thus, an angle of a side surface of the circular saw blade 51 relative to the upper surface of the base 11 can be finely controlled. The construction shown in FIG. 7 can reduce a size of the support segment 41 to provide a compact miter saw while maintaining the sufficient movement of the saw blade section 50 relative to the guide bar section 30.

The rearmost position of the saw blade support section 40 is defined by the abutment of the support segment 41 onto the holder 22, and the frontmost position of the saw blade support section 40 is defined by the abutment of the support segment 41 onto the front end cap 32. Moreover, the disengagement of the support segment 41 from the guide bars 31 can be prevented by the front end cap 32. Incidentally, since only the support segment 41 supporting the saw blade section 50 is slidingly moved on the guide bars 31, only a small amount of load is imparted on the ball bearing 42 in a direction perpendicular to the sliding direction. Further, the load is constant regardless of the sliding position of the support segment 41 relative to the guide bars 31. Accordingly, a compact ball bearing 42 is available.

As shown in FIG. 7, a pivot shaft 46 laterally extends through the support segment 41 in a direction perpendicular to the axial direction of the guide bars 31. The saw blade section 50 is pivotally movable about an axis of the pivot shaft 46. A recess 41*c* is formed in the support segment 41 at a position below the pivot shaft 46. A laser oscillator 47 is disposed in the recess 41*c*. The laser oscillator 47 is movable within the recess 41*c* at least in the axial direction of the circular saw blade 51, so that the laser beam can extends along the side surface of the circular saw blade 51. Thus, a cutting line which is an extension of the side surface can be irradiated onto the workpiece W to be cut. This facilitates recognition of the position of the circular saw blade 51 prior to cutting, thereby enhancing operability.

Within the recess 41*c*, a spring 48 is disposed. The spring 48 is disposed over the pivot shaft 46 and has one end acting on the support segment 41 and another end acting on the saw blade section 50 for normally urging the saw blade section 50 to be pivotally moved away from the upper surface of the base 11 about the axis of the pivot shaft 46. A stop mechanism (not shown) is provided for maintaining the saw blade section 50 at its uppermost position during non-operating state. For the cutting operation, the saw blade section 50 is pivotally moved downwardly against the biasing force of the spring 48.

As described above, the guide bars 31 are not protringly moved rearward from the holder 22 during cutting, and the holder 22 does not move away from the base section 10 in frontward/rearward direction during cutting. Therefore, entire miter saw 1 becomes compact even during cutting operation. Thus, cutting work can be performed in a narrow space. In other words, it is unnecessary to provide a surplus space between an ambient wall and the rearmost end of the miter saw 1.

5. Saw Blade Section 50

Figure 8:
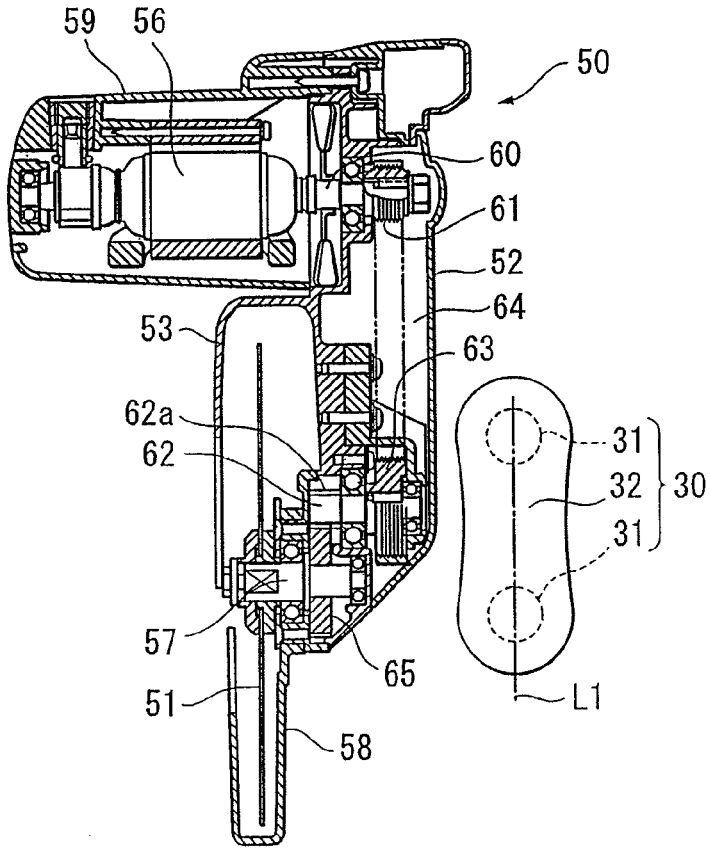
FIG. 8 is a cross-sectional view taken along the line VIII-VIII of FIG. 1 for particularly showing the saw blade section.
Figure 9:
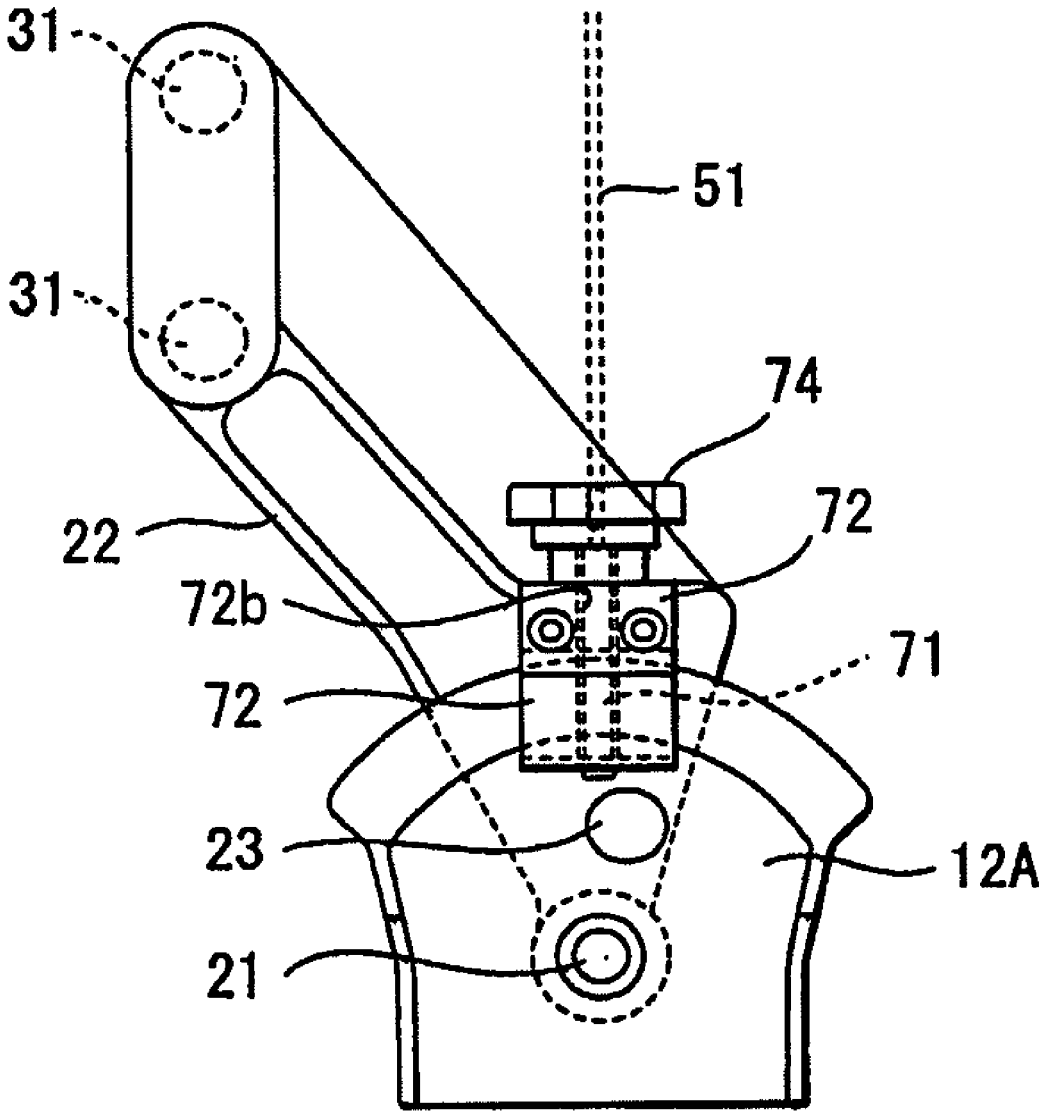
FIG. 9 is an enlarged view showing an essential portion of a holder fixing mechanism in the miter saw according to the first embodiment.

The saw blade section 50 includes a gear case 52 pivotally movably supported to the support segment 41 through the pivot shaft 46. As shown in FIG. 8, a saw blade cover 53 is provided integrally with the gear case 52 for covering an upper half of the circular saw blade 51. The saw blade cover 53 is formed with a cutting chip discharge port 53*a* (FIG. 3) open toward the holder 22. A dust collection bag 66 (FIG. 1) can be attached to the discharge port 53*a*. Alternatively, a hose (not shown) of a vacuum device can be attached to the discharge port 53*a* for preventing the cutting chip from scattering.

Incidentally, dust collection bag 66 has its rearmost end positioned frontward of a rearmost component of the miter saw 1. (In FIG. 1, the rearmost component is a protruding portion 72 described later.) With this arrangement, the effective dust collection can be performed even if a wall or ambient object exists immediately near at the rear side of the holder 22. Such arrangement can be realized by designing a size of the dust collection bag 66 or by inclining orientation of the discharge port 53*a* relative to the side surface of the circular saw blade 51. As a result, the dust collection bag 66 does not affect the installation space for the miter saw 1.

A saw blade shaft 57 is rotatably supported on the gear case 52. The circular saw blade 51 is coaxially mounted on the saw blade shaft 57. A safety cover 58 is pivotally supported to the gear cover 52 for protectively covering a portion of the circular saw blade 51 projecting out of the saw blade cover 53. The safety cover 58 is adapted to cover the projecting out portion of the circular saw blade 51 when the saw blade section 50 is at the upper pivot position shown in FIG. 1, and to expose the projecting out portion to the atmosphere when the saw blade section 50 is at the lower pivot position shown in FIG. 3. To this effect, a link mechanism (not shown) is provided for pivotally retracting the safety cover 58 into the saw blade cover 53.

A motor housing 59 is fixed to the gear cover 52. The motor housing 59 houses therein the motor 56 which has a motor shaft 60 extending in parallel with the saw blade shaft 57 and supported rotatably on the gear case 52. The motor 56 is positioned such that an imaginary plane containing the side surface of the circular saw blade 51 intersects a part of the motor 56. Further, a handle 54 is provided integrally with the motor housing 59. The handle 54 is located on an imaginary plane containing the side surface of the circular saw blade 51. With this arrangement, reaction force imparted on the saw blade section 50 through the circular saw blade 51 during cutting can be properly received by the handle 54. In other words, reaction force from the circular saw blade 51 is linearly transmitted to the handle 54 without any deviation. A switch 55 is provided to the handle 54 for driving a motor 56.

A sub-handle 67 is provided integrally with the motor housing 59. The sub-handle 67 extends in a direction parallel with the guide bars 31 when the saw blade section 51 is pivotaly moved to its most downward position as shown in FIG. 3. The motor housing 59 is provided with a fixing arrangement (not shown) for fixing the lowermost pivot posture of the saw blade section 50 relative to the support segment 41. Upon fixing the lowermost pivot position, the user can easily carry the miter saw 1 by gripping the sub-handle 67.

A power transmission mechanism is provided in the gear case 52 for transmitting the rotation of the motor shaft 60 to the saw blade shaft 57. The transmission mechanism includes a motor shaft pulley 61, an intermediate shaft 62, an intermediate shaft pulley 63, an endless belt 64, a pinion 62*a*, and a gear 65. The motor shaft pulley 61 is fixed to a tip end of the motor shaft 60 at which a fan is fixed. The intermediate shaft 62 is positioned close to and in parallel with the saw blade shaft 57 and is rotatably supported on the gear case 52. The intermediate shaft pulley 63 is integrally rotatable with the intermediate shaft 62 and is disposed at a side opposite to the circular saw blade 51. The endless belt 64 is mounted on the motor shaft pulley 61 and the intermediate shaft pulley 63.

The pinion 62*a* is formed at an outer peripheral surface of the intermediate shaft 62 and at a side opposite to the intermediate shaft pulley 63. The pinion 62*a* is positioned closest to the circular saw blade 51 among the components on the intermediate shaft 62. The gear 65 is force-fitted with the saw blade shaft 57. As a result, the gear 65 is rotatable together with the rotation of the saw blade shaft 57 and in alignment with the pinion 62*a* for meshing engagement therewith.

As shown in FIGS. 4 and 8, the upper and lower guide bars 31, 31 are arrayed in a direction parallel with the side surface of the circular saw blade 51. That is, an imaginary line L1 connecting axes of the upper and lower guide bars 31,31 extends in parallel with the side surface of the circular saw blade 51. With this arrangement, rigidity of the sliding segments 43*a*, 43*b* and rigidity of the bores 22*a* of the holder 22 can be maintained when the saw blade section 50 is pivotally moved downwardly and when the miter saw 1 is hand-carried while gripping the sub-handle 67.

As shown in FIG. 1, the saw blade shaft 57 is positioned close to the guide bars 31, 31 when the saw blade section 50 is at the uppermost pivot position. Therefore, the guide bars 31,31 do not become significant factor or bar for downsizing the entire miter saw 1. Moreover, since a distance between the handle 54 and the circular saw blade 51 in the axial direction of the saw blade shaft 57 is extremely small, the saw blade support section 40 carrying the saw blade section 50 can smoothly slides on the guide bars 31, 31 when the saw blade section 50 is maintained at its most downward posture for cutting the workpiece W having an elongated length in the frontward/rearward direction of the miter saw 1. Furthermore, because of the above-described geometrical relationship between the motor 56 and the side surface of the circular saw blade 51 and because of the geometrical relationship in the power transmission mechanism including the endless belt 64, entire width of the saw blade section in the axial direction of the circular saw blade 51 can be reduced. Accordingly, the guide bar support section 20 and the saw blade section 50 can be tilted up to 45 degrees even toward a side where the guide bars 31 exist as shown in FIG. 5. Of course the guide bar support section 20 and the saw blade section 50 can be tilted up to 45 degrees leftward as shown in FIG. 6. Further, since the motor shaft 60 and the saw blade shaft 57 extend in parallel with each other, a height of the saw blade section 50 can be reduced thereby reducing an entire height of the miter saw 1.

6. Holder Fixing Mechanism 70

The holder fixing mechanism 70 will next be described with reference to FIGS. 1 through 3 and 9. The holder fixing mechanism 70 is adapted to fix the holder 22 to the base section 10 so as to fix the pivot position of the holder 22 about an axis of the holder shaft 21 in order to fix the inclination angle of the side surface of the circular saw blade 51 relative to the upper surface of the base 11 and the turntable 12.

As described above, the turntable 12 has the rearmost upstanding portion 12A whose upper end portion is configured into an arcuate shape protruding upwardly to form an engagement region 71. The holder 22 is provided with a protruding portion 72 including a horizontal section 72A protruding rearward from a rear surface 22*a* of the holder 22 and a vertical section 72B extending downwardly from the horizontal section 72A. Thus, a part of the engagement region 71 is surrounded by the rear surface 22*b* of the holder 22 and the protruding portion 72. Further, a locus of the protruding portion 72 in accordance with the pivotal motion of the holder 22 corresponds to the arcuate shape of the engagement region 71.

The vertical section 72B has an inward slant wall surface 72*a* inclined such that a distance between the slant wall surface 72*a* and the rear surface of the engagement region 71 is gradually increased toward the axis of the holder shaft 21. Further, a slider 73 is movably disposed between the engagement region 71 and the vertical section 72B. The slider 73 has a rear slant wall surface 73*a* complementary with the slant wall surface 72*a* and in sliding contact therewith. The horizontal section 72A is formed with a through-hole 72*b* extending toward the axis of the holder shaft 21.

A clamp bolt 74 extends through the through-hole 72*b* and is rotatable about its axis. An inner diameter of the through-hole 72*b* is slightly greater than an outer diameter of the clamp bolt 74. The clamp bolt 74 has a tip end threadingly engaged with the slider 73. A spring 75 is disposed over the clamp bolt 74 and is interposed between the horizontal section 72A and the slider 73 for normally urging the slider 73 toward the holder shaft 21. By the rotation of the clamp bolt 74, the slider 73 is moved along an axis of the clamp bolt 74. In other words, an axis of the clamp bolt 74 extends perpendicular to the axis of the holder shaft 21, and substantially in parallel with the side surface of the circular saw blade 51.

Therefore, the locus of the slider 73 is positioned substantially along an imaginary plane which is an extension of the side surface of the circular saw blade 51 regardless of the pivotal posture of the saw blade section 50. Thus, even if the holder 22 is slightly moved relative to the holder shaft 21 due to a minute clearance therebetween during the movement of the slider 73, the minute movement of the holder 22 relative to the holder shaft 21 is in alignment with the locus of the slider 73. Accordingly, the pivot angle of the saw blade section 50, i.e., the tilting angle of the circular saw blade 51, can be maintained regardless of the clearance. In other words, when clamping the pivot posture of the saw blade section 50, the circular saw blade 51 may be minutely displaced due to the clearance between components. However, the displacing direction is always in alignment with the extending direction of the clamp bolt 74. Thus, accidental displacement of the circular saw blade 51 relative to an intended cutting position can be avoided.

In a state shown in FIGS. 1 and 4, the pivot position of the holder 22 relative to the turntable 12 is fixed. In this state, the slider 73 is at its uppermost position, so that the engagement region 71 of the turntable 12 is clamped between the rear surface 22*b* of the holder 22 and the slider 73. Thus, the holder 22 is immovable relative to the turntable 12. More specifically, the clamp bolt 74 is in its clamping state so that the slider 73 deeply thrusts into a space between the slant surface 72*a* and the rear surface of the rearmost upstanding portion 12A. Thus, the tapered surface of the slider 73 and the slant surface 72*a* of the protruding portion 72 is in intimate contact with each other, and the spring 34 is in its compressed state. In other words, the engagement region 71 is firmly nipped between the slider 73 and the holder 22 to prevent the holder 22 from free pivotal movement relative to the turntable 12. Thus, pivot position of the saw blade section 50 can be fixed.

For laterally tilting the saw blade section 50, the clamp bolt 74 is unfastened for releasing the holder 22. By this unclamping, the slider 73 is moved downward toward the holder shaft 21 by own weight of the slider 72 and expansion of the spring 75 in its axial direction. Thus, contacting force between the rear surface 22*b* of the holder 22 and the engagement region 71 of the turntable 12 is weakened, so that the holder 22 is freely pivotally movable relative to the turntable 12 about the axis of the holder shaft 21. As a result, the holder 22 can be tilted rightward or leftward as shown in FIGS. 5 and 6.

Then, the clamping is again performed while the user holds the saw blade section 50 at its desired pivot posture. That is, while the user maintains a desired pivot posture of the saw blade section 50 with his one hand, the user clamps the clamp bolt 74 with his remaining hand. If the holder 22 is tilted rightward in FIG. 5, the stop portion 22B is brought into abutment with the stop bolt 15B, so that the tilting angle of the saw blade section 50 is set at 45 degrees. With this posture, the clamp bolt 74 is fastened to fix the tilting position of the holder 22. The same is true with respect to the leftward tilting of the holder 22 as shown in FIG. 6. For laterally tilting the saw blade section 50, the holder 22 is tilted rightward or leftward. In this case, because the center of the gravity of the motor 56 is in vertical alignment with the holder shaft 21 when the holder 22 is in vertical orientation, the saw blade section 50 can be tilted with constant force regardless of the tilting direction.

If the slider 73 relatively deeply thrusts the space between the engagement region 71 and the vertical section 72B as a result of excessive clamping, the slider 73 may not be moved toward the holder shaft 21 even by the own weight of the slider 73 and by the biasing force of the spring 75 as a result of unclamping the clamp bolt 74. In such case, the slider 73 can be moved toward the holder shaft 21 by simply pushing down the clamp bolt 74 after unclamping.

Clamping and unclamping to the holder 22 is performed mainly by a movement of the slider 73 in the axial direction of the clamp bolt 74. As described above, the slider 73 can be slightly moved toward the vertical section 72B due to the clearance between the outer diameter of the clamp bolt 74 and the inner diameter of the through-hole 72*b*. Further, a minute clearance may be provided between the rear surface 22*b* of the holder 22 and the engagement region 71. Consequently, the engagement region 71 is tightly nipped between the rear surface 22*b* and the slider 73 so as to absorb these clearances as a result of minute movement of the holder 22 in the frontward/rearward direction.

For cutting the workpiece W, the motor 56 is energized upon pressing the switch 55 for rotating the motor shaft 60, whereupon the circular saw blade 51 is rotated through the pulley 52, the transmission belt 64, the intermediate shaft pulley 63 and the saw blade shaft 57. While maintaining this state, an operator grips the handle 54 and pushes the saw blade section 50 downwardly against the biasing force of the spring 48. The circular saw blade 51 is entered into the groove of the blade entry plate in the turntable 12. If the saw blade section 50 is pivotally moved by a predetermined amount as shown in FIG. 3, the pivot motion is stopped by the stop mechanism (not shown). Thus, one end (front end) portion of the workpiece W can be cut. For cutting the workpiece having an elongated length in the frontward/rearward direction, the support segment 41 carrying the saw blade section 50 is provisionally moved to its frontmost position along the guide bars 31. Then, after the saw blade section 50 is pivoted downwardly, the saw blade section 50 is moved rearward along the guide bars 31.

If cutting to the workpiece W is completed, the operator pulls up the handle 54, so that the saw blade section 50 can restore its original uppermost position by the biasing force of the spring 48.

For performing a vertical cutting in which the side surface of the circular saw blade 51 extends vertically, the clamp bolt 74 is unfastened and the pin 23 is displaced frontward. Then, the holder 22 is pivotally moved toward its vertical posture. As a result, the pin 23 abuts the stop bolt 24 whereupon the vertical orientation of the circular saw blade 51 is established. Then, the clamp bolt 74 is fastened in the above-described manner.

A workpiece having a wide area can be subjected to angled cutting and slant cutting as well as the above-described vertical cutting by moving the saw blade section 51 in the frontward/rearward direction. The angled cutting implies that the cutting line on the workpiece W is slanted with respect to the frontward/rearward direction. This angled cutting is achievable by angularly rotating the turntable 12 to change the geometrical relationship between the fences 13 and the side surface of the circular saw blade 51. The slant cutting implies that the cutting line in a thickness direction of the workpiece is slanted by controlling the pivot angle of the holder 22 relative to the turntable 12. To this effect, the knob 45 is loosened for facilitating sliding movement of the support segment 41 relative to the guide bars 31. In this way, composite cutting is achievable including vertical cutting, angled cutting and slant cutting.

Because the clamp bolt 74 extends toward the holder shaft 21, the manipulating portion of the clamp bolt 74 is easily accessible, even if the user or user's hand does not move to a position rearward of the holder fixing mechanism 70 or even if a wall or impediment exists nearby the rear side of the miter saw 1. Therefore, a work for fixing a desired pivot angle of the saw blade section 50 can be facilitated. Further, when installing the miter saw 1, it is unnecessary to provide a space between a wall and the rear side of the miter saw 1. Thus, an entire working space can be reduced. Further, since the clamp bolt 74 extends toward the holder shaft 21, entire length of the miter saw 1 in the frontward/rearward direction can be reduced.

Figure 10:
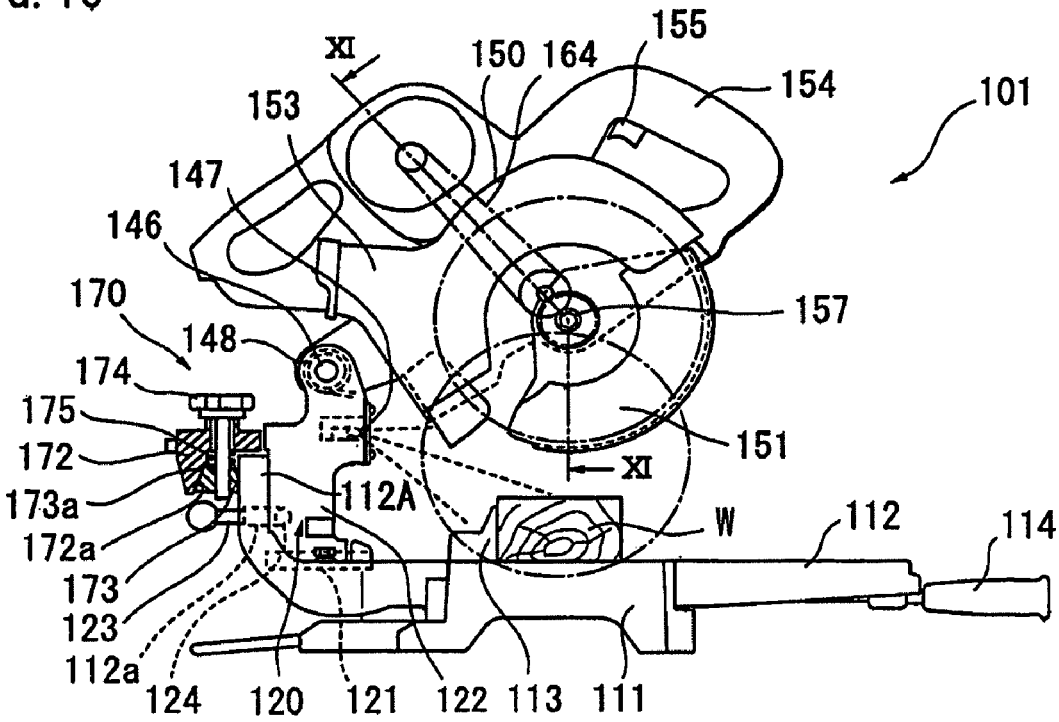
FIG. 10 is a side view of a miter saw with a laterally tiltable saw blade section according to a second embodiment of the present invention, and showing a state where the circular saw blade section is positioned at its uppermost position.
Figure 11:
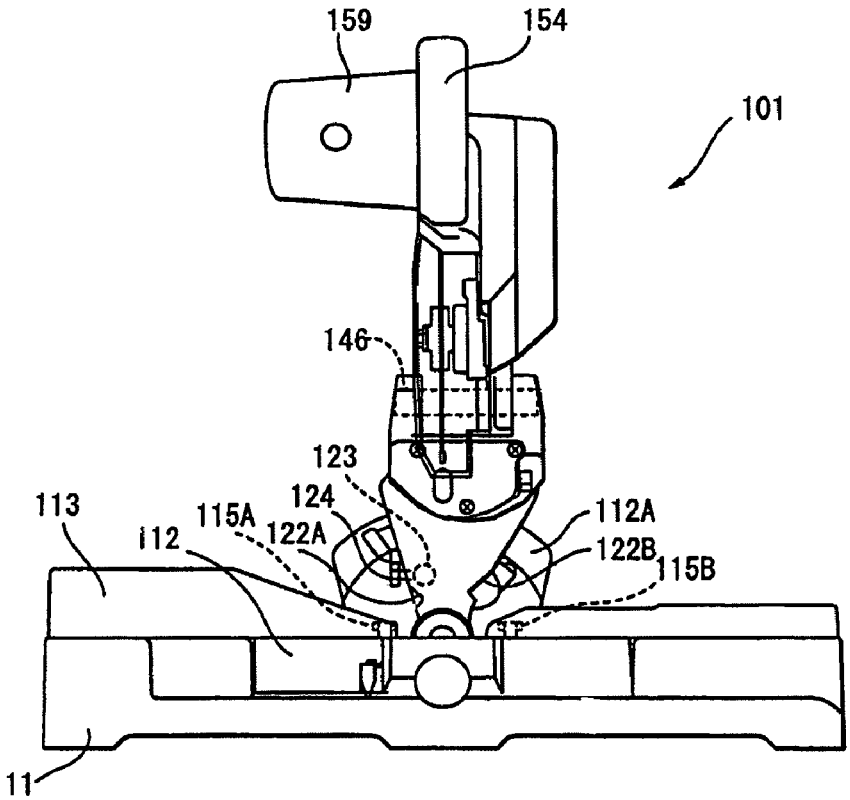
FIG. 11 is a front view of the miter saw according to the second embodiment and particularly showing a vertical orientation of the saw blade section.

A miter saw according to a second embodiment of the present invention will be described with reference to FIGS. 10 and 11, wherein like parts and components are designated by the same reference numerals as those shown in FIGS. 1 through 9 but added with 100. The miter saw 101 in the second embodiment is not provided with the guide bar section 30 and the saw blade support section 40 in the first embodiment. Instead, the saw blade section 150 is directly pivotally movably connected to the holder 122. Therefore, the section 120 should not be referred to as the guide bar support section, but should be referred to as a saw blade section supporting section 120. The holder 122 has an upper end portion provided with a pivot shaft 146 corresponding to the pivot shaft 46 of the first embodiment. Further, a spring 148 corresponding to the spring 48 of the first embodiment is interposed between the holder 122 and the saw blade cover 153.

A holder fixing mechanism 170 is the same as the holder fixing mechanism 70 in the first embodiment. In summary, the clamp bolt 174 has an axis extending in a direction perpendicular to the axis of the holder shaft 121, and further, the axis of the clamp bolt 174 extends in alignment with the side surface of the circular saw blade 151.

A miter saw according to a third embodiment of the present invention will be described with reference to FIGS. 12 through 14 wherein like parts and components are designated by the same reference numerals as those shown in FIGS. 1 through 9 but added with 200. In the miter saw 1 according to the first embodiment, the pair of guide bars 31 are immovably fixed to the holder 22, and the saw blade support section 40 is slidable relative to the guide bars 31. On the other hand, in the miter saw 201 according to the third embodiment, the pair of guide bars 231 are slidable relative to the holder 222, and the support segment 241 for supporting the saw blade section 250 is fixed to the guide bars 231.

Figure 12:
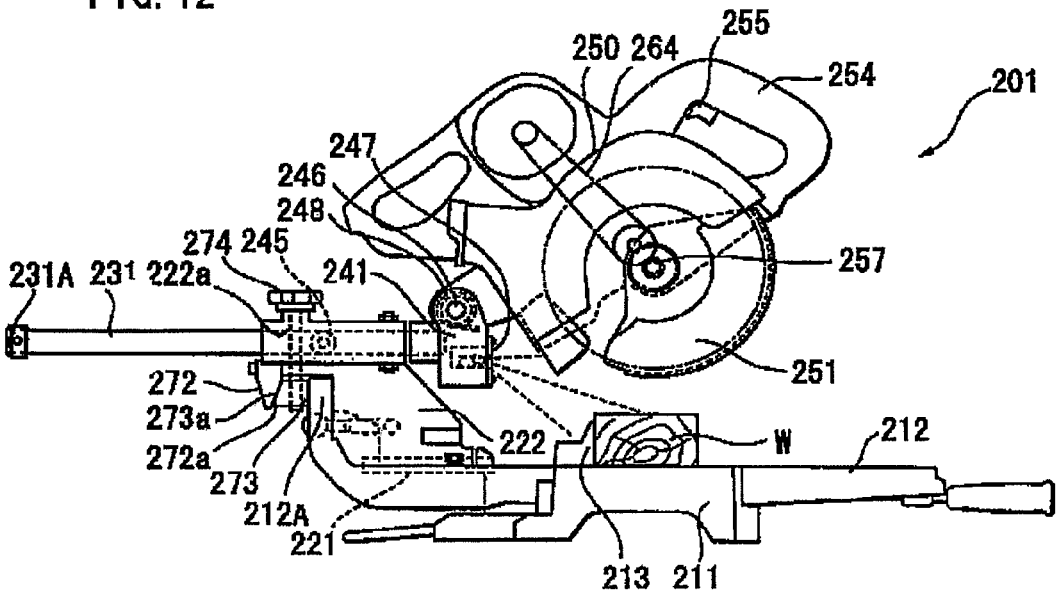
FIG. 12 is a side view of a miter saw with a laterally tiltable saw blade section according to a third embodiment of the present invention, and showing a state where a circular saw blade section is positioned at its uppermost position.
Figure 13:
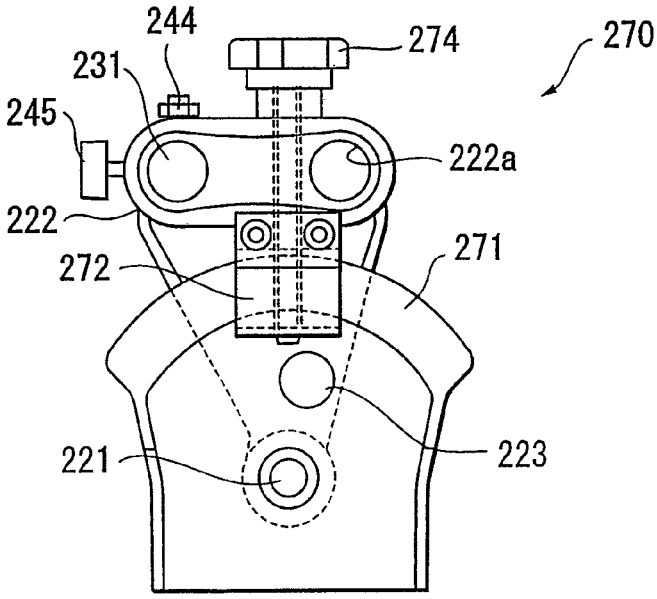
FIG. 13 is a partially enlarged rear view particularly showing a holder fixing mechanism in the miter saw according to the third embodiment.
Figure 14:
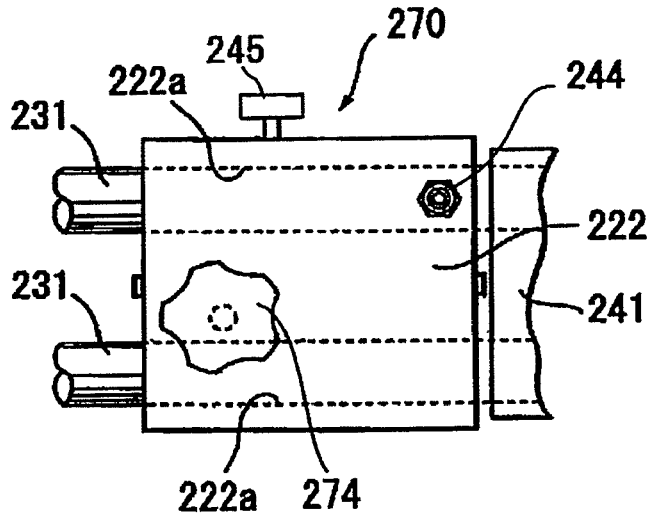
FIG. 14 is a partially enlarged plan view showing the holder fixing mechanism and a pair of guide bars according to the third embodiment.

As shown in FIGS. 12 and 13, the upper end portion of the holder 222 is formed with a pair of through-holes 222*a* extending in a horizontal direction and positioned side by side at the identical vertical position. The pair of guide bars 231 slidably extend through the through-holes 222*a*. Therefore, an imaginary line connecting the center axes of the guide bars 231 extends in parallel with the saw blade shaft 257. Further, an end cap 231A is fixed at the rear end of each guide bars 231 for avoiding accidental release of the guide bars 231 from the holder 222. The support segment 241 is fixed at the front end of each guide bars 231. A bolt 244 corresponds to the bolt 44A for finely controlling inclination of the support segment 241. A knob 245 corresponds to the knob 45 for stopping the axial sliding movement of the guide bar 231.

The holder fixing mechanism 270 is substantially the same as the holder fixing mechanisms 70 and 170 of the first and second embodiments. The clamp bolt 274 extends through the upper end portion of the holder 222 at a position between the pair of through-holes 222*a* and 222*a*. The clamp bolt 274 has an axis extending in a direction perpendicular to the holder shaft 221 and substantially parallel with the side surface of the circular saw blade 251. Incidentally, FIG. 14 shows a state where the guide bars 231 have been moved to their most rearward positions, so that the support segment 241 is positioned close to the holder 222.

Figure 15:
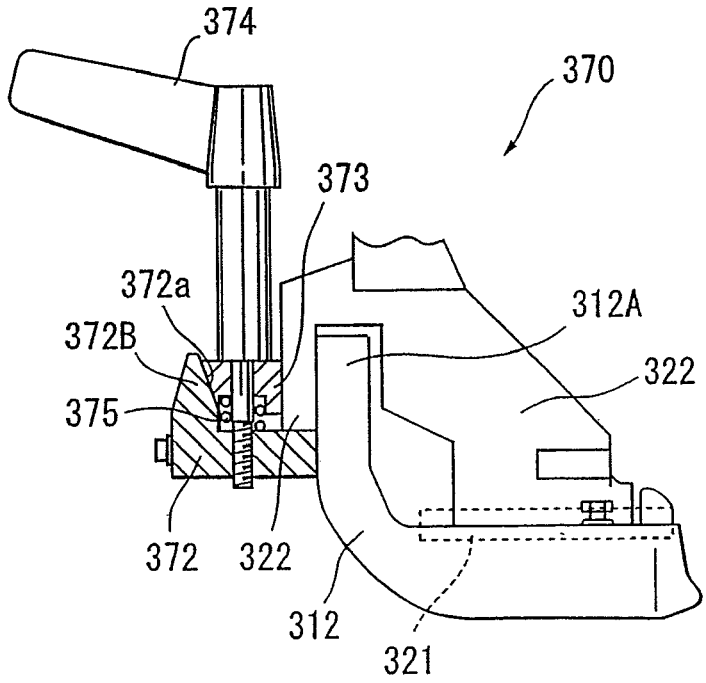
FIG. 15 is a partially enlarged side view showing a holder fixing mechanism in a miter saw according to a fourth embodiment of the present invention.

A miter saw having a holder fixing mechanism according to a fourth embodiment of the present invention is shown in FIG. 15 wherein like parts and components are designated by the same reference numerals as those shown in FIGS. 1 through 9 but added with 300. In the foregoing embodiments, the protruding portion 72, 172, 272 are provided at the holder 22, 122, 222. However, in the fourth embodiment, the protruding portion 372 is provided at a rearmost upstanding portion 312A of the turntable 312. Further, the holder 322 has a rearmost nipped region 322A positioned at immediately rear side of the rearmost upstanding portion 312A. The vertical section 372B extends upward from the horizontal section 327A, and provides the slant surface 372*a*.

A clamp lever 374 has a shaft portion extending in a direction perpendicular to the holder shaft 321 and substantially in parallel with the side surface of the circular saw blade. The shaft portion of the clamp lever 374 is not threadingly engaged with the slider 373, but is threadingly engaged with the horizontal section 372A. The spring 375 is interposed between the horizontal section 372A and the slider 373 for normally biasing the slider 373 upward. The nipped region 322A is nipped between the upstanding portion 312A and the front surface of the slider 373.

If the slider 373 is moved downward by the rotation of the clamp lever 374 against the biasing force of the spring 375, the nipped region 322A is tightly nipped between the upstanding portion 312A and the front surface of the slider 373 to fix a desired tilting posture of the holder 322. If the slider 373 is moved upward by the biasing force of the spring 375 as a result of reversal rotation of the clamp lever 374, the nipping force is weakened to allow the holder 322 to be pivotally moved about the pivot shaft 321.

Figure 16:
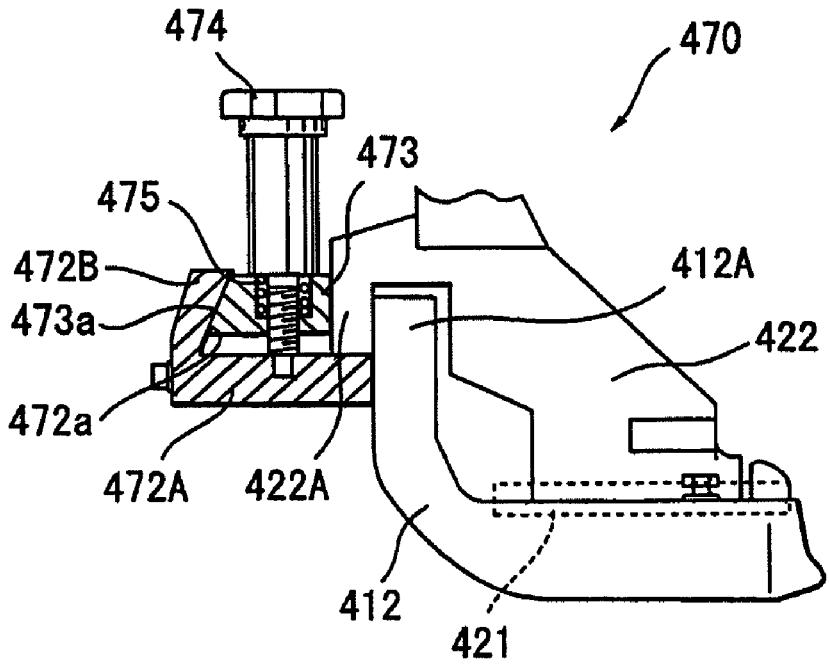
FIG. 16 is a partially enlarged side view showing a holder fixing mechanism in a miter saw according to a fifth embodiment of the present invention.

A miter saw having a holder fixing mechanism according to a fifth embodiment of the present invention is shown in FIG. 16 wherein like parts and components are designated by the same reference numerals as those shown in FIGS. 1 through 9 but added with 400. The holder fixing mechanism 470 is substantially the same as that of the fourth embodiment. However, the slant surface 472*a* is directed in the reverse direction in comparison with the fourth embodiment. The clamp bolt 474 is threadingly engaged with the slider 473, and is supported to the horizontal section 472A of the protruding portion 472. The upper portion of the slider 473 is formed with a recess in which the spring 475 is disposed. The spring 475 is interposed between the clamp bolt 474 and the slider 473. The clamp bolt 474 has an axis extending in a direction perpendicular to the holder shaft 421 and substantially in parallel with the side surface of the circular saw blade.

If the slider 473 is moved upward by the rotation of the clamp bolt 474, the nipped region 422A of the holder 422 is tightly nipped between the upstanding portion 412A of the turntable 412 and the slider 473. If the slider 473 is moved downward by the reversal rotation of the clamp bolt 474, the nipping is released.

Figure 17:
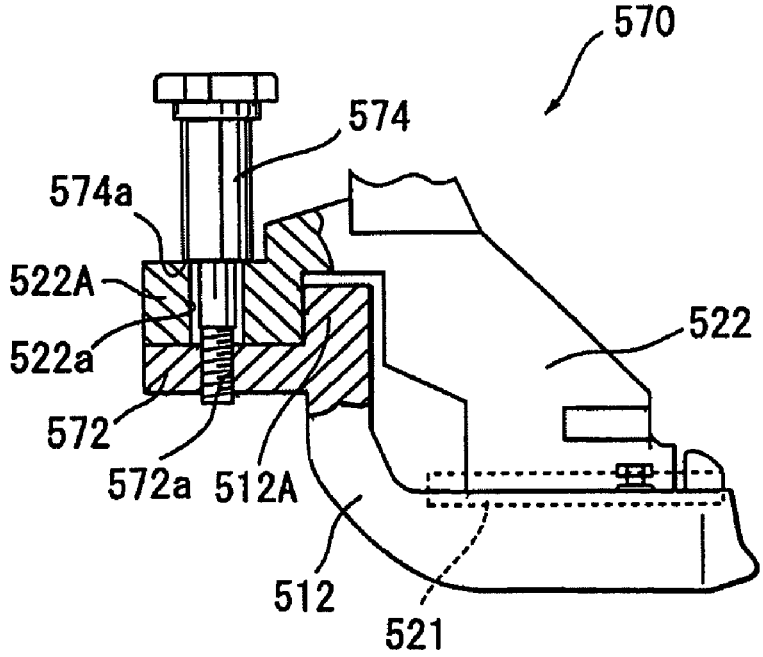
FIG. 17 is a partially enlarged side view showing a holder fixing mechanism in a miter saw according to a sixth embodiment of the present invention.

A miter saw having a holder fixing mechanism according to a sixth embodiment of the present invention is shown in FIG. 17 wherein like parts and components are designated by the same reference numerals as those shown in FIGS. 1 through 9 but added with 500. In the holder fixing mechanism 570, a component corresponding to the slider 73, 173, 273, 373, 473 is not provided. Instead, an arcuate protruding portion 572 protrudes from the upstanding portion 512A of the turntable 512. The arcuate protruding portion 572 is on an imaginary circle whose center is coincident with the axis of the pivot shaft 521. The arcuate protruding portion 572 is formed with a female thread 572*a*.

The holder 522 has a rearmost arcuate portion 522A positioned immediately above the arcuate protruding portion 572. The rearmost arcuate portion 522A is on an imaginary circle whose center is coincident with the axis of the pivot shaft 521. Further, an arcuate slot 522*a* is formed in the rearmost arcuate portion 522A. The clamp bolt 574 extends through the arcuate slot 522*a* and is threadingly engaged with the female thread 572*a*. The clamp bolt 574 has a stepped portion 574*a* seated on the upper surface of the rearmost arcuate portion 522A. The clamp bolt 574 has an axis extending in a direction perpendicular to the holder shaft 521 and substantially in parallel with the side surface of the circular saw blade.

When the clamp bolt 574 is unfastened, the rearmost arcuate portion 522A is movable relative to the arcuate protruding portion 572. Therefore, the holder 522 is pivotally movable about the pivot shaft 521 within an arcuate length of the arcuate slot 522*a*. On the other hand, when the clamp bolt 574 is fastened, the rearmost arcuate portion 522A is immovable relative to the arcuate protruding portion 572. Therefore, the pivot posture of the holder 522 is fixed.

Thus, according to the foregoing embodiments, it is unnecessary for the user's hand to sneak around to the rear side of the holder in order to manipulate the clamp bolt or the clamp lever so as to change the pivot posture of the holder. In other words, the user's hand is easily accessible to the clamp bolt or the clamp lever, enhancing workability. Moreover, a surplus space is not necessary at the rear side of the miter saw for the manipulation to the clamp bolt or the clamp lever thereby reducing entire working space.

Further, the axis of the clamp bolt or the clamp lever extends perpendicular to the holder shaft and substantially in parallel with the side surface of the circular saw blade. With this arrangement, a minute movement of the holder relative to the pivot shaft due to dimensional clearance therebetween occurs along the extending direction of the clamp bolt or the clamp lever. Therefore, the circular saw blade can be positioned at a correct orientation to perform sharpshooting against the intended cutting position on the workpiece even upon fixing the tilting posture of the holder regardless of the minute movement.

Moreover, the perpendicular relationship between the axis of the clamp bolt or clamp lever and the holder shaft provides advantage in that the rotation of the clamp bolt or the clamp lever does not cause pivotal movement of the holder about the holder shaft. This is in high contrast to a conventional arrangement in which a clamp lever extends in parallel with the holder shaft. In the latter case, the rotation of the clamp lever causes minute pivotal movement of the holder about the holder shaft, since the clamp lever is in direct contact with the holder during rotation of the clamp lever.

While the invention has been described in detail with reference to specific embodiments thereof, it would be apparent to those skilled in the art that various changes and modifications may be made therein without departing from the spirit and scope of the invention. For example, the numbers of the guide bars 31 is not limited to two, but one or three guide bars can be used.

Further, in the above-described embodiment, the saw blade section can be pivotally moved rightward and leftward. However, a saw blade section pivotable only leftward or only rightward is also available.

Further, in the saw blade section of the above-described embodiments, the power transmission mechanism is disposed at right side of the circular saw blade in FIG. 8. However, the power transmission mechanism can be positioned at left side of the circular saw blade. Further, the turntable can be dispensed with in the base section. Further, in FIG. 7, the bearing 42 can be provided at the upper bore 41*a*, and the slide segments assemblies 43*a*, 43*b* 44*a*, 44*b*, 45 can be disposed in the lower bore 41*b*.

What is claimed is:

1. A miter saw comprising:

a base section having an upper surface on which a workpiece is mounted, the base section defining a frontward/rearward direction and a lateral direction perpendicular to the frontward/rearward direction;

a saw blade section rotatably supporting a circular saw blade, the circular saw blade having a rotation axis extending in the lateral direction;

a holder shaft extending in a direction perpendicular to the rotation axis and in the frontward/rearward direction;

a holder tiltable about the holder shaft in the lateral direction relative to the base section;

two guide bars disposed slidable with respect to the holder and extending in the frontward/rearward direction in parallel to each other;

a support segment fixed to the guide bars and supporting the saw blade section;

a pivot shaft disposed between the saw blade section and the support segment and extending in parallel with the rotation axis, the saw blade section being pivotable about the pivot shaft and movably supported to the support section toward and away from the upper surface; and a holder fixing mechanism that fixes a tilting posture of the holder relative to the base section, the holder fixing mechanism comprising an operation member supported to the holder and provided with a rotatable shaft passing through a space between the two guide bars;

wherein the rotatable shaft of the operation member extends in a direction perpendicular to the holder shaft and in a direction substantially parallel with opposite side surfaces of the circular saw blade.

2. The miter saw as claimed in claim 1, wherein the rotatable shaft of the operation member, the holder shaft, and the circular saw blade are positioned in substantially a same plane.

3. The miter saw as claimed in claim 1, wherein the holder is tiltable laterally rightward and leftward by an angle of 45 degrees, respectively.

4. The miter saw as claimed in claim 1, further comprising a knob engaged with the holder for stopping axial sliding movement of the guide bars.

5. The miter saw as claimed in claim 1, further comprising an adjustment arrangement provided at the holder for finely controlling inclination of the guide bars.

6. A miter saw comprising:

a base section having an upper surface on which a workpiece is mounted, the base section defining a frontward/rearward direction and a lateral direction perpendicular to the frontward/rearward direction;

a saw blade section rotatably supporting a circular saw blade, the circular saw blade having a rotation axis extending in the lateral direction;

a holder shaft extending in a direction perpendicular to the rotation axis and in the frontward/rearward direction;

a holder tiltable about the holder shaft in the lateral direction relative to the base section;

two guide bars disposed slidable with respect to the holder and extending in the frontward/rearward direction in parallel to each other;

a support segment fixed to the guide bars and supporting the saw blade section;

a pivot shaft disposed between the saw blade section and the support segment and extending in parallel with the rotation axis, the saw blade section being pivotable about the pivot shaft and movably supported to the support section toward and away from the upper surface; and a holder fixing mechanism that fixes a tilting posture of the holder relative to the base section, the holder fixing mechanism comprising an operation member supported to the holder and provided with a rotatable shaft passing through a space between the two guide bars;

wherein the operation member includes a part which is positioned above the two guide bars and the rotatable shaft extends from the part and passes through the space which extends between the two guide bars.

7. The miter saw as claimed in claim 6, wherein the rotatable shaft of the operation member, the holder shaft, and the circular saw blade are positioned in substantially a same plane.

8. The miter saw as claimed in claim 6, wherein the holder is tiltable laterally rightward and leftward by an angle of 45 degrees, respectively.

9. The miter saw as claimed in claim 6, further comprising a knob engaged with the holder for stopping axial sliding movement of the guide bars.

10. The miter saw as claimed in claim 6, further comprising an adjustment arrangement provided at the holder for finely controlling inclination of the guide bars.

11. The miter saw as claimed in claim 6, wherein the rotatable shaft of the operation member extends in a direction perpendicular to the holder shaft and in a direction substantially parallel with opposite side surfaces of the circular saw blade.

12. The miter saw as claimed in claim 6, wherein the two guide bars which extend in parallel to each other are spaced from each other so that the two guide bars lie in a single plane within the space extending between the two guide bars, and the rotatable shaft of the operation member of the holder fixing mechanism passes through the single plane within the space in a direction transverse to the single plane.

13. The miter saw as claimed in claim 6, wherein the rotatable shaft of the operation member extends in a direction transverse to the extension direction of the holder shaft.

* * * * *